US007667651B2

(12) United States Patent
McKivergan

(10) Patent No.: US 7,667,651 B2
(45) Date of Patent: Feb. 23, 2010

(54) POLARIZATION AGILE ANTENNA

(75) Inventor: Patrick D. McKivergan, Londonderry, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 531 days.

(21) Appl. No.: 11/579,368

(22) PCT Filed: Aug. 18, 2005

(86) PCT No.: PCT/US2005/029317

§ 371 (c)(1),
(2), (4) Date: Nov. 2, 2006

(87) PCT Pub. No.: WO2006/031364

PCT Pub. Date: Mar. 23, 2006

(65) Prior Publication Data

US 2009/0160724 A1 Jun. 25, 2009

Related U.S. Application Data

(60) Provisional application No. 60/608,260, filed on Sep. 9, 2004.

(51) Int. Cl.
*H01Q 1/38* (2006.01)

(52) U.S. Cl. ..... 343/700 MS; 343/742; 343/867

(58) Field of Classification Search ..... 343/700 MS, 343/745, 867, 742, 866, 741
See application file for complete search history.

(56) References Cited

U.S. PATENT DOCUMENTS

| | | | | |
|---|---|---|---|---|
| 4,410,891 | A | 10/1983 | Schaubert et al. | |
| 4,644,366 | A | 2/1987 | Scholz | |
| 5,661,494 | A | 8/1997 | Bondyopadhyay | |
| 5,844,525 | A | 12/1998 | Hayes et al. | |
| 5,943,016 | A | 8/1999 | Snyder, Jr. et al. | |
| 5,977,929 | A | 11/1999 | Ryken | |
| 6,281,847 | B1 | 8/2001 | Lee | |
| 6,545,630 | B1 | 4/2003 | Apa et al. | |
| 6,680,703 | B1 * | 1/2004 | McConnell | 343/700 MS |

OTHER PUBLICATIONS

Navsariwala, et al., "A Switched Polarization Dual Loop Antenna For 2.4 GHz ISM Band Applications", Antennas And Propagation Society International Symposium, 2002, IEEE, vol. 4, Publication date Jun. 16-21, 2002, pp. 52-55.

* cited by examiner

*Primary Examiner*—Hoang V Nguyen
(74) *Attorney, Agent, or Firm*—Daniel J. Long; Michael Sand

(57) ABSTRACT

A compact polarization agile antenna includes a dual-orthogonal loop structure which is excited by a single RF feed (21). The loop structure includes a pair of loops (8, 10), each loop is connected to ground (45) through a complex impedance via a solid state switch (41, 43). Current flows in the loop when the switch (41, 43) is closed. The switches (41, 43) and impedances (47, 49) in each leg are independently controlled. Additionally, the relative phase of the current in each leg can be controlled over a narrow bandwidth via a complex impedance for narrowband circular polarized applications. Using this approach, orthogonal linear, slant, or left-hand and right-hand circular polarizations can be generated.

10 Claims, 8 Drawing Sheets

POLARIZATION AGILE ANTENNA

CROSS REFERENCE TO RELATED APPLICATION

This application claims rights under 35 USC 119(e) from U.S. application Ser. No. 60/608,260 filed Sep. 9, 2004, the contents of which are incorporated herein by reference.

BACKGROUND OF THE INVENTION

1. Technical Field

The present invention relates to antennas, and more particularly to polarization agile antennas. Even more particularly, the invention relates to an antenna formed of metallic radiating elements on a printed circuit board which form a dual-orthogonal loop structure having a single RF feed for generating orthogonal linear, slant and circular polarizations.

2. Background Information

Many antenna systems require some sort of polarization diversity for optimum performance. This need generally adds to the cost and complexity of the antenna system. A single feed antenna simplifies system design since there is only one RF port. Common prior art methods for polarization switching utilize multiple orthogonal antennas with the appropriate phase shift. A less sophisticated approach to polarization agility is to mechanically steer a linear polarized antenna. Such methods require either an RF switch or multiple RF channels which adds to cost and complexity.

There is, therefore, the need for dynamic polarization switching to optimize communication and radar system performance without requiring separate RF feeds for multiple antennas or mechanical steering.

BRIEF SUMMARY OF THE INVENTION

The present invention is a compact polarization agile antenna which includes a dual-orthogonal loop structure which includes a pair of loops, each of which is excited by a single RF feed. Each loop is connected to ground through a generalized complex impedance, which can include a short or open circuit, via a solid state switch. Current flows in the loop when the switch is closed. For narrowband circular-polarized applications, the relative phase of the current in each leg can be controlled over a narrow bandwidth by choosing the proper complex impedance. The switches and impedances in each leg are independently controlled. Using this approach, orthogonal linear, slant or left-hand and right-hand circular polarizations can be generated.

Another aspect of the invention is to form the antenna of a plurality of metallic radiating strips mounted on a dielectric substrate as in a printed circuit board, to form a small, compact rugged antenna structure.

A further feature of the antenna is the ability to easily tune the antenna by changing the spacing or gaps between leg elements of the antenna provided by the metallic strips.

Still another aspect of the invention is to form the printed circuit board with a cubic configuration with a bottom surface of the cube being the ground plane, wherein the common RF feed extends along one edge or the Z-axis of the cube, and a pair of radiation legs extends along the edges or the X-axis and Y-axis of a planar top surface of the cube which is generally parallel with the ground plane, and in which a pair of ground legs extend along a portion of the radiating legs and along respective side surfaces of the cube to the ground plane.

Still another aspect of the invention is to form the top surface of the printed circuit board cube with an area of less than $0.01\lambda^2$.

BRIEF DESCRIPTION OF THE SEVERAL VIEWS OF THE DRAWINGS

The present invention is further described with reference to the accompanying drawings wherein.

Similar numbers refer to similar parts throughout the drawings.

DETAILED DESCRIPTION OF THE INVENTION

Figure 1:
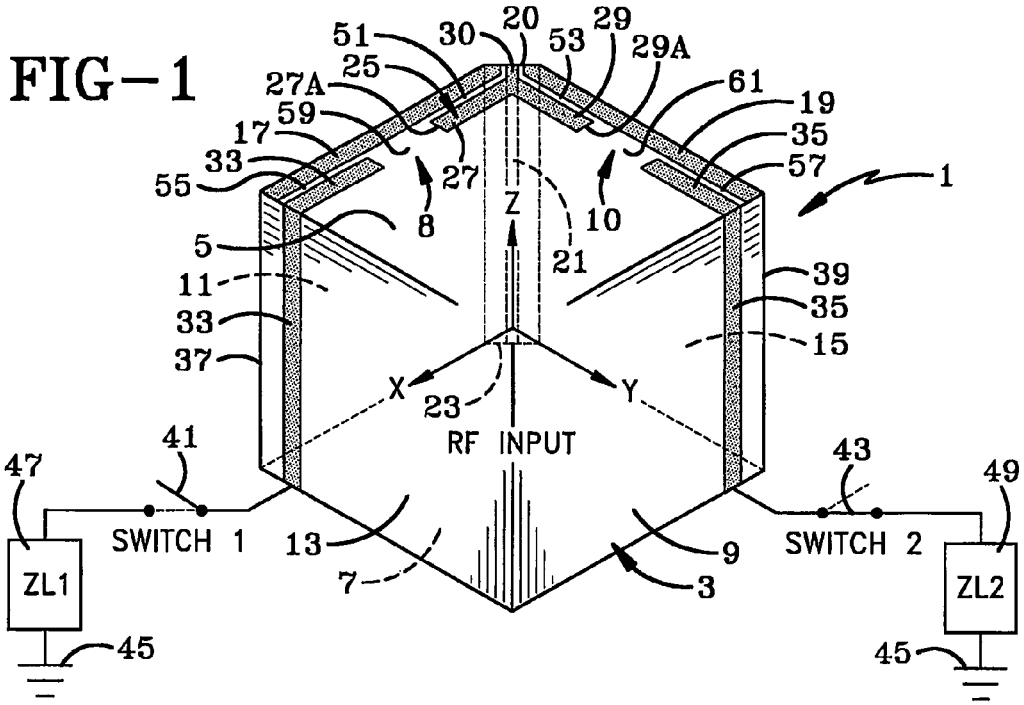
FIG. 1 is a schematic perspective illustration of a preferred embodiment of the antenna of the present invention.
Figure 2:
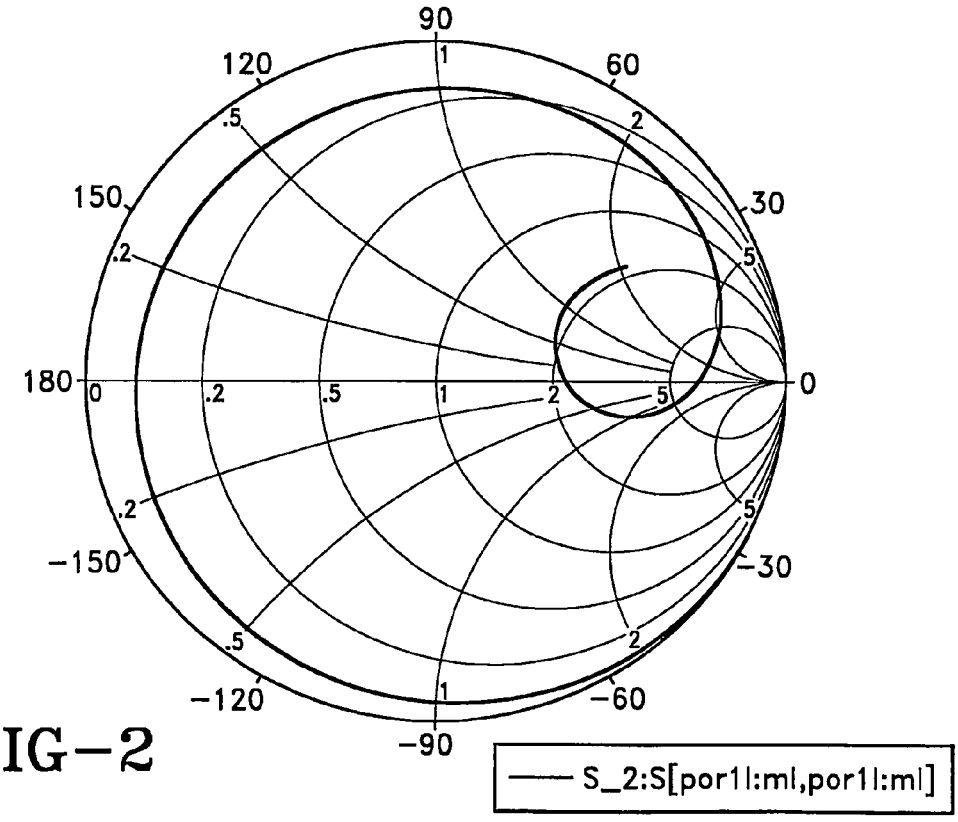
FIG. 2 is a Smith chart showing typical input impedance for the antenna shown in FIG. 1.
Figure 1B:
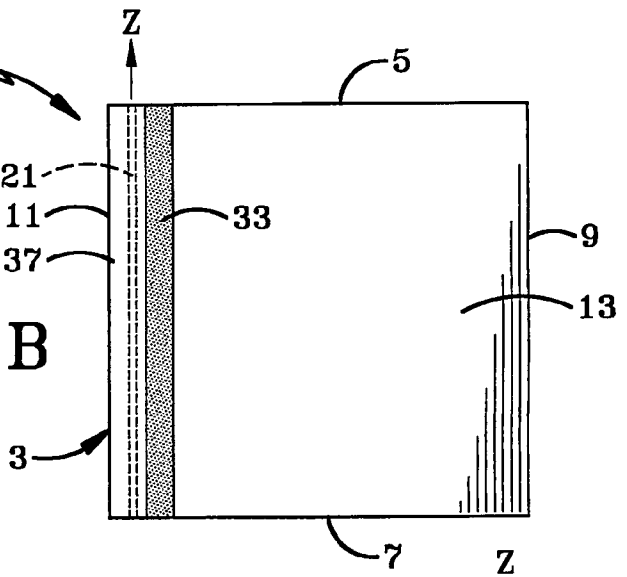
FIG. 1B is a diagrammatic view of the antenna of FIG. 1A looking down the X-axis in the direction of arrows 1B.
Figure 1C:
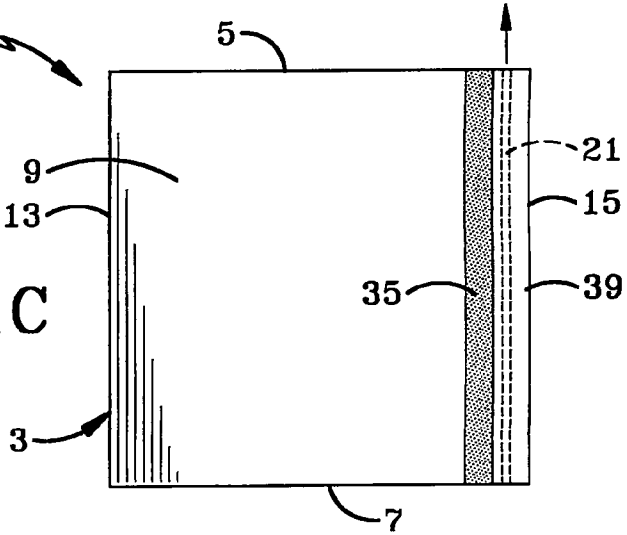
FIG. 1C is a diagrammatic view of the antenna of FIG. 1A looking down the Y-axis in the direction of arrows 1C.
Figure 1A:
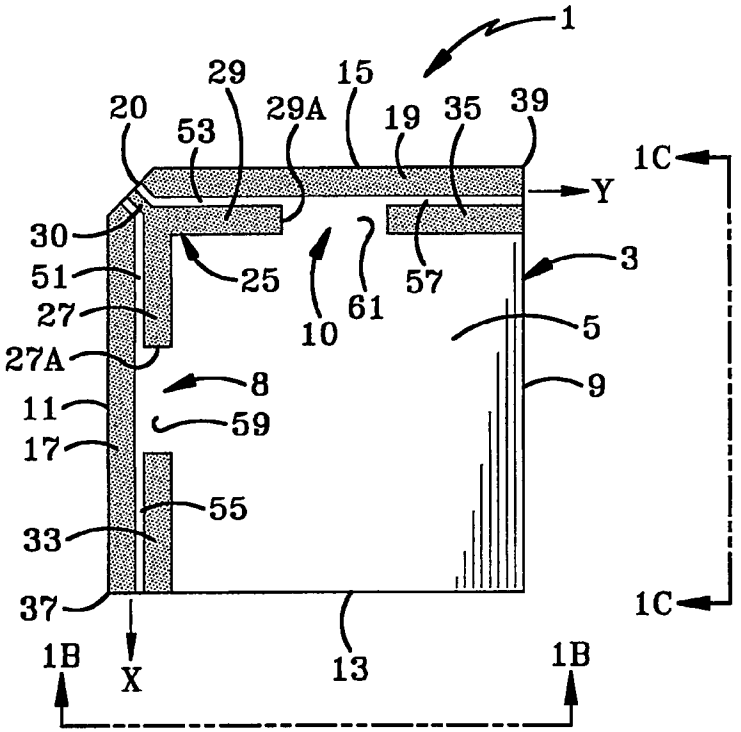
FIG. 1A is a diagrammatic top plan view of the antenna of FIG. 1.

The antenna of the present invention is indicated generally at 1, and is best shown in FIG. 1. Antenna 1 includes a printed circuit board, preferably in the shape of a cube 3 having top and bottom surfaces 5 and 7, and two pairs of opposed side surfaces 9,11 and 13,15, respectively. Printed circuit board 3 includes a dual orthogonal loop structure formed by a pair of loops indicated generally at 8 and 10. The respective loops include a main radiating element or leg 17 and 19 extending outwardly from each other at corner 20 and along the edges of top surface 5 at generally right angles to each other, as best shown in FIG. 1A. Legs 17 and 19 extend along the X-axis and Y-axis, respectively of cube 3, and preferably extend throughout the length of top surface 5. A common RF signal feed strip 21 extends upwardly from a lower corner 23 of bottom surface 7 where it is connected to the RF input. Feed strip 21 extends along the Z-axis of cube 3 to adjacent corner 20 where it connects to a common terminal 30 of a pair of radiating signal feed legs 27 and 29 which extend outwardly from terminal 30. Feed legs 27 and 29 extend a short distance along top surface 5 and are spaced closely adjacent to and parallel with legs 17 and 19, respectively. Legs 27 and 29 terminate in end edges 27A and 29A, respectively.

Each respective loop of the dual orthogonal loop structure further includes a ground strip 33, 35 which extend along top surface 5 and are spaced closely adjacent to and parallel with a respective one of the radiating legs 17 and 19. Ground strips 33 and 35 continue along side surfaces 13 and 15, respectively of cube 3 terminating at bottom surface 7 (FIGS. 1, 1B and 1C). Preferably, top surface 5 of cube 3 has an area of less than $0.01\lambda^2$ to achieve the desired results.

In further accordance with the invention, a pair of switches 41 and 43 are connected to ground strips 33 and 35, respectively, and in one embodiment are connected to ground 45 through complex impedances 47 and 49, as shown in FIG. 1. Switches 41 and 43 preferably will be solid state switches well known in the antenna art, and thus are not described in further detail. Gaps 51 and 53 are formed between legs 17 and 19 and legs 27 and 29, respectively, and provide capacitive coupling between the RF feed and the radiating elements. Gaps 55 and 57 are provided between legs 17 and 19 and ground legs 33 and 35, respectively. Also, tuning gaps 59 and 61 are provided between the adjacent end edges of feed strips 27 and 29 and ground strips 33 and 35, respectively.

It is understood that the (printed circuit board) which in the preferred embodiment in cube 3, is formed of a dielectric material, but need not be cubical so long as it provides support for the metallic strip and the arrangement thereof as discussed above and shown particularly in FIGS. 1 through 1C. Furthermore, the desired results of the antenna of the present invention could be achieved by a hardwired circuit in contrast to the printed circuit board as discussed above. However, a printed circuit is preferred since it provides an inexpensive structure which can be easily and economically manufactured in a compact, rugged and lightweight structure.

Figure 3:
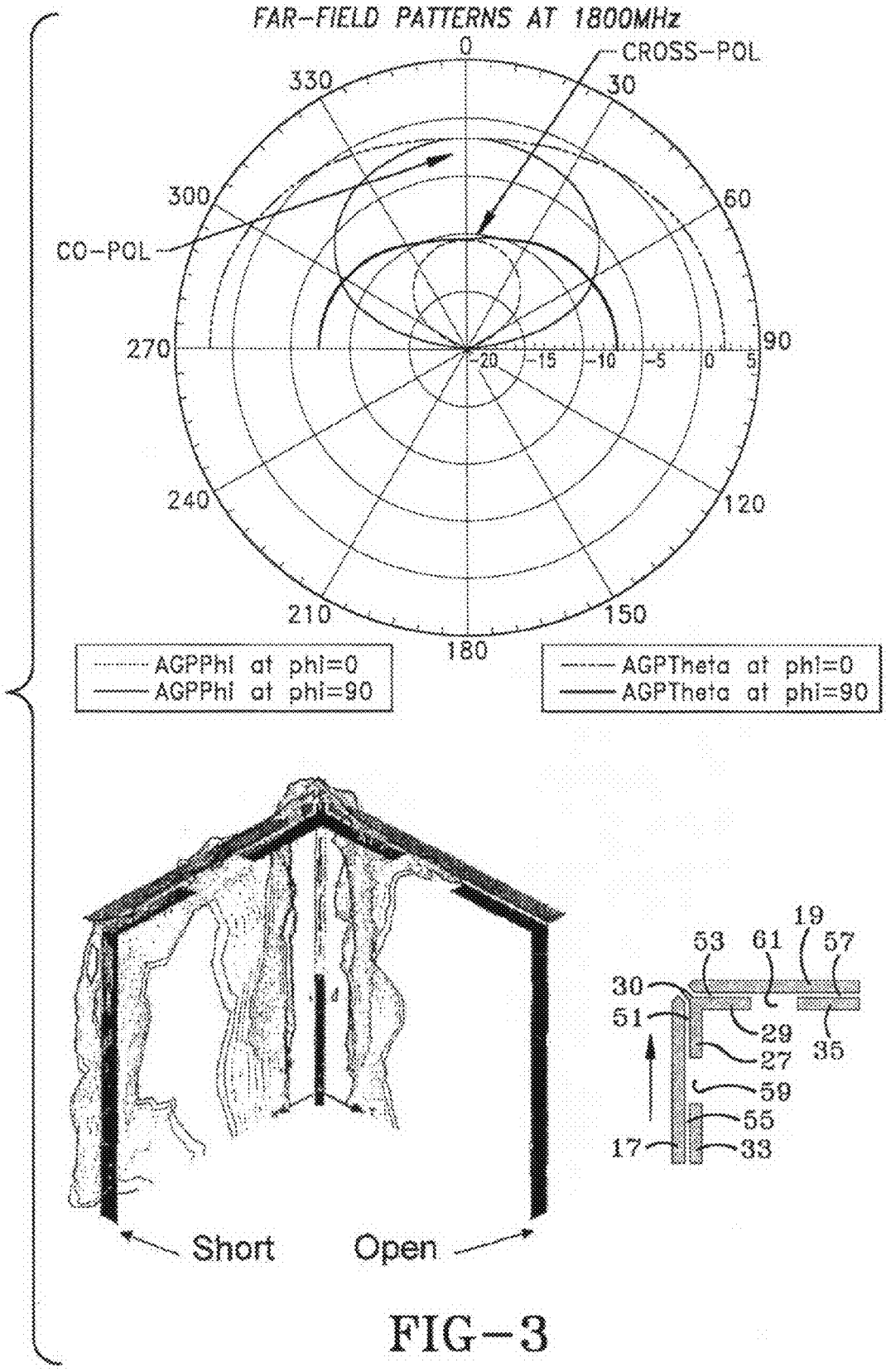
FIG. 3 is a graph and perspective schematic illustration showing radiation patterns and H-field magnitude with the first switch closed and the second switch open.
Figure 4:
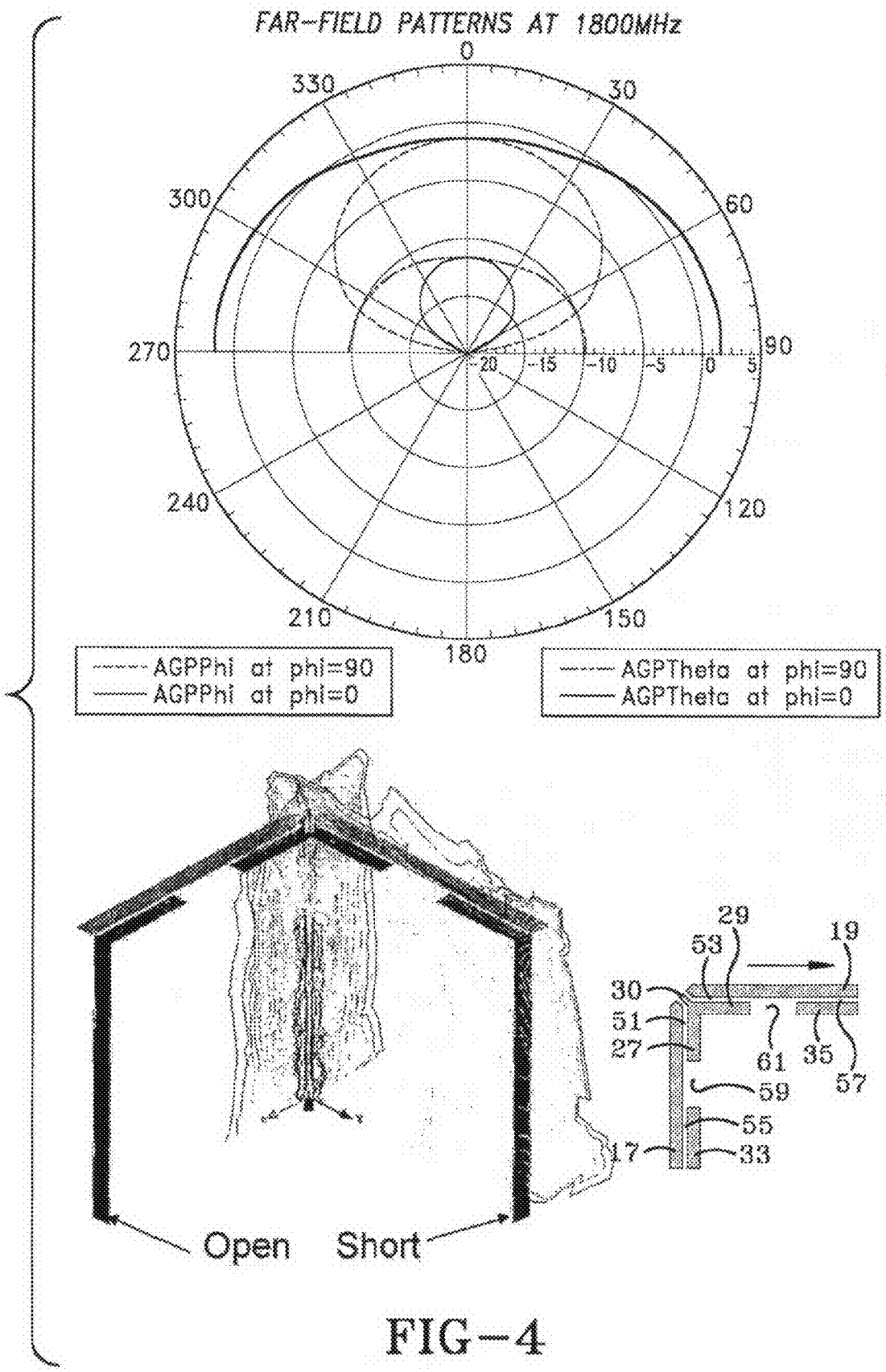
FIG. 4 is a graph and perspective schematic illustration similar to FIG. 3 showing radiation patterns and H-field magnitude with the second switch closed and the first switch open.

To achieve linear polarization, either vertical or horizontal, switches 41 and 43 are selectively opened and closed. For example, as shown in FIG. 3, switch 41 is closed and switch 43 is opened. This connects leg 33 to ground causing current to flow through leg 17 which creates an H-field about legs 17, 21, 29 and 33 as shown in FIG. 3. An opposite linear polarization is achieved as shown in FIG. 4 by opening switch 41 and closing switch 43 which connects leg 35 to ground causing current to flow in the elements of the right side orthogonal antenna loop 10 of cube 3.

Switch 41 and 43 need not be connected to ground 45 through complex impedances 47 and 49 for the antenna to perform its intended function. This can also be achieved by replacing the impedance with a short circuit to achieve the linear polarization as discussed above without affecting the concept of the invention.

Figure 5:
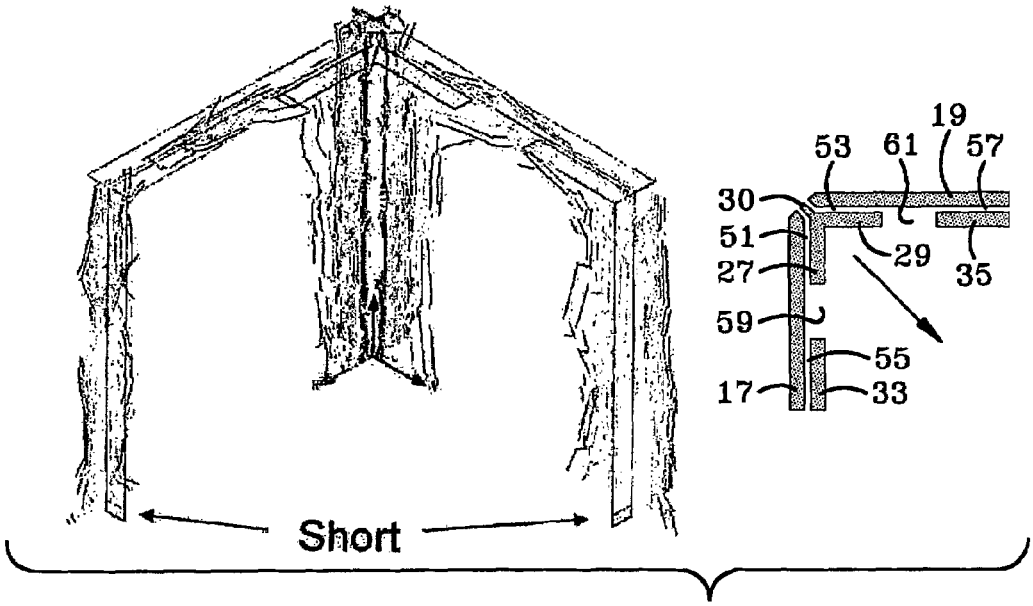
FIG. 5 is a perspective schematic illustration showing the H-field and polarization vector diagram when both switches are closed for dual-linear excitation.
Figure 6:
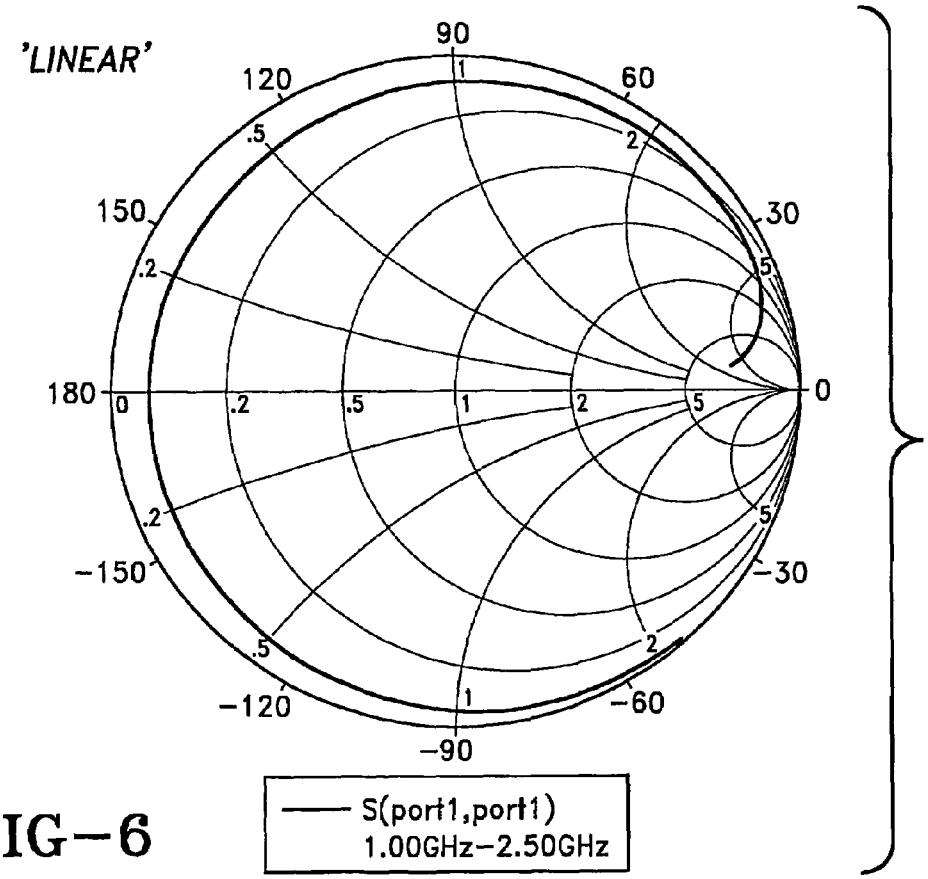
FIG. 6 is an impedance chart for the dual linear excitation of the condition shown in FIG. 5.

In furtherance of the invention, a slanted linear polarization is achieved by the antenna of the present invention as shown in FIGS. 5 and 6. In the example of FIGS. 5 and 6, both switches 41 and 43 are closed and the two loop circuits are connected to ground, either directly through a short circuit or by the use of impedances 47 and 49. This produces the slanted polarization as shown by the diagram of FIG. 5 and the impedance chart of FIG. 6.

Figure 7:
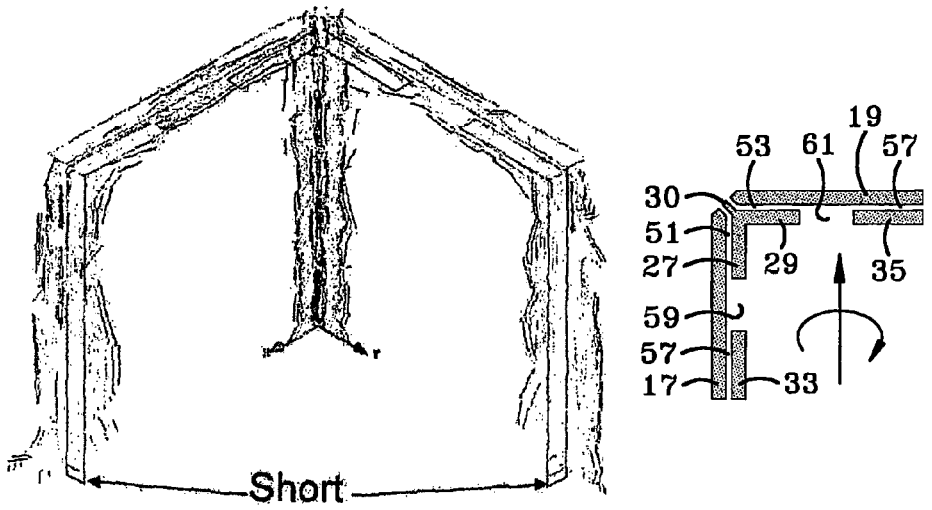
FIG. 7 is a perspective schematic illustration showing the H-field and polarization vector diagram when both switches are closed and a change of capacitance occurs in one leg of the antenna to generate circular polarization (CP)
Figure 8:
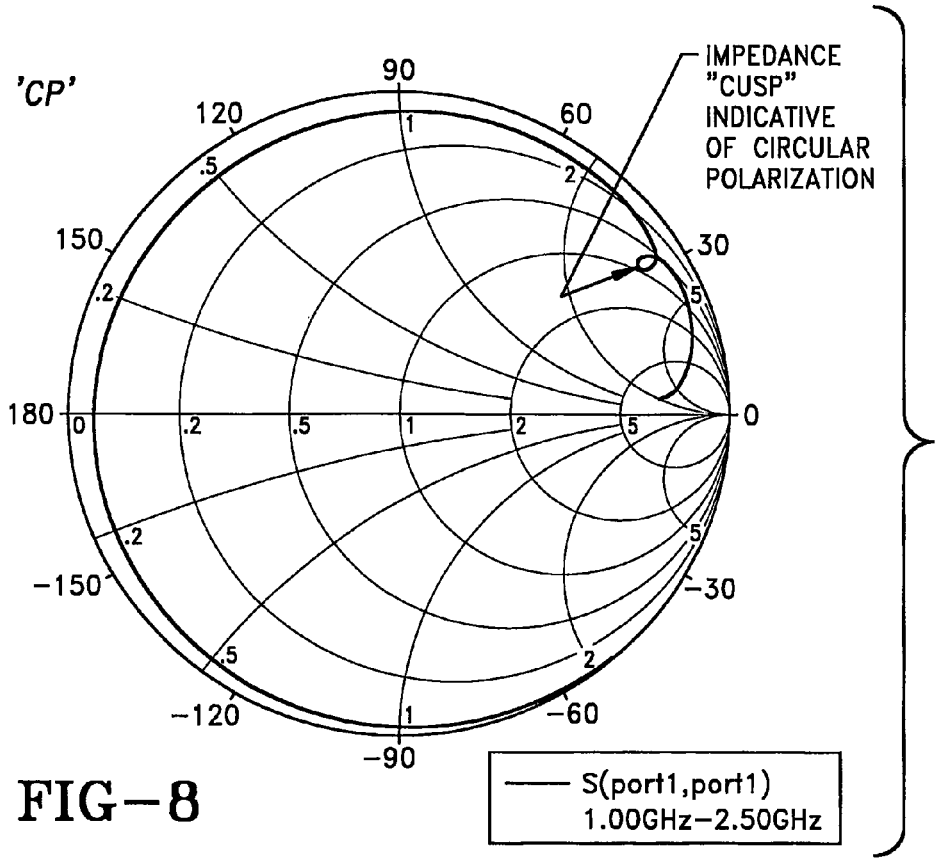
FIG. 8 is a Smith chart showing impedance when the antenna is circular-polarized.
Figure 9:
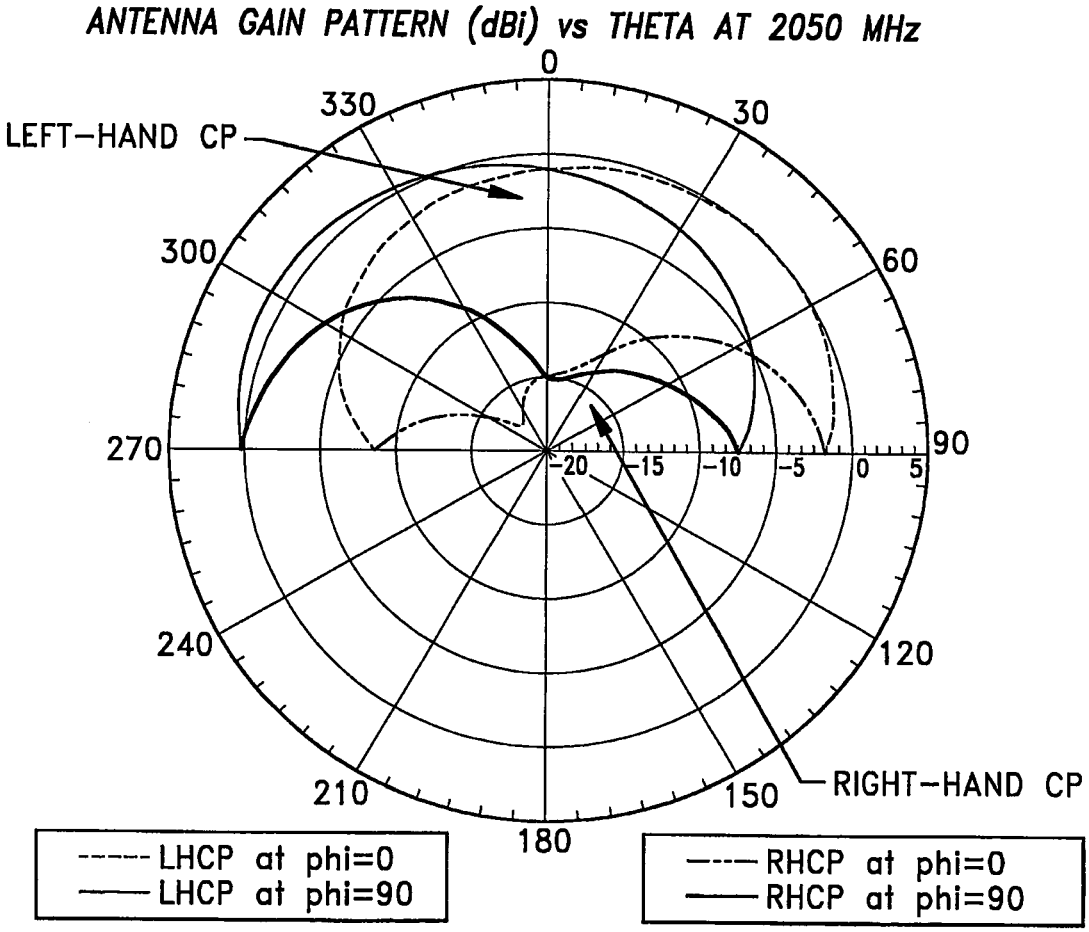
FIG. 9 is a chart showing an example of the antenna gain pattern when the antenna is circular polarized.
Figure 10:
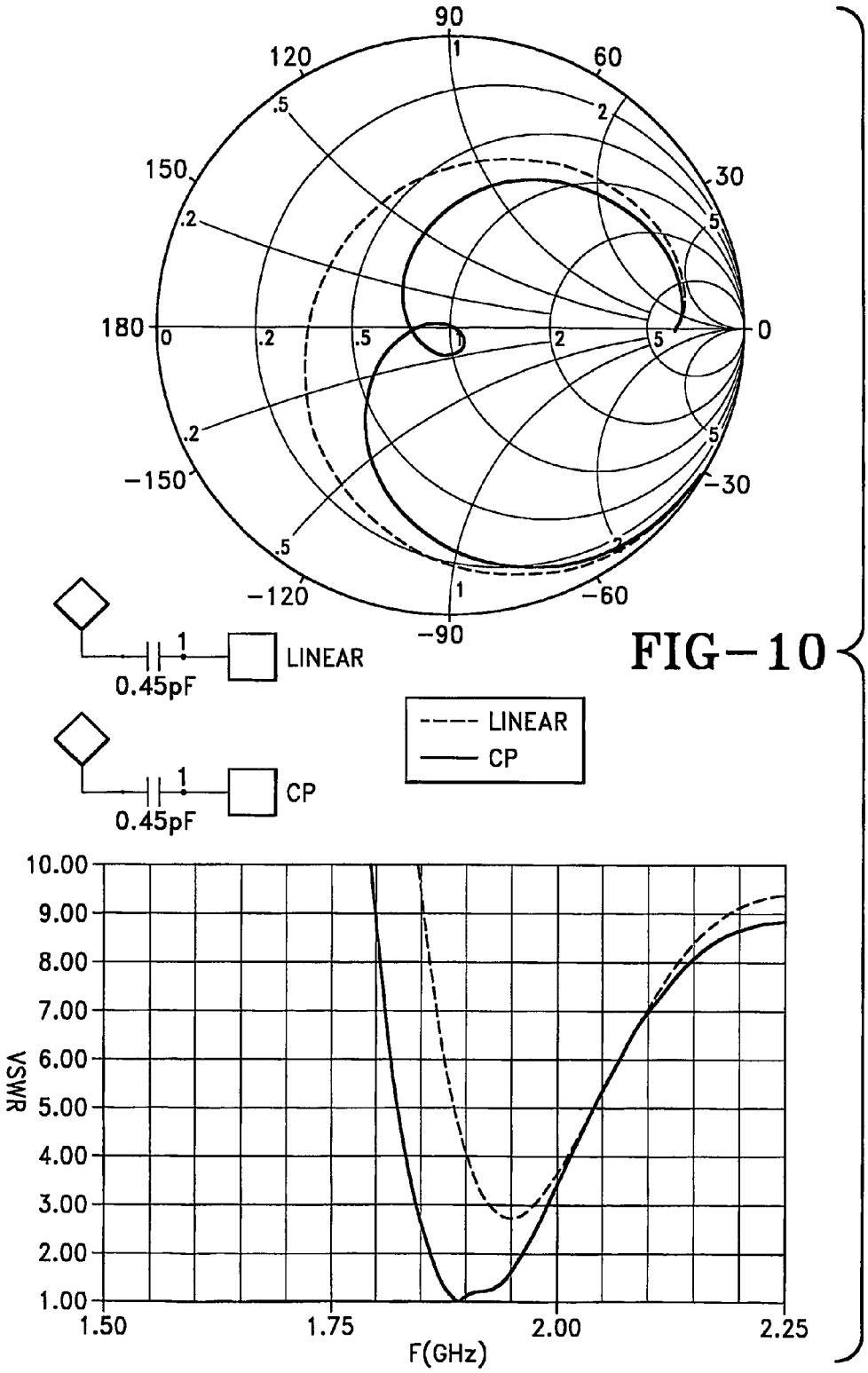
FIG. 10 is a chart, graph and schematic diagrams showing impedance matching for both linear and circular polarization.

FIGS. 7-9 shows the results when the dual orthogonal circuit of FIG. 1 is modified to achieve circular polarization, for example by a change of capacitance in one leg of the antenna. One manner in which this is accomplished is to increase the width of the gaps in one of the circuits such as shown in FIG. 7 where gap 51 between legs 17 and 27 is different than gap 53 between legs 19 and 29. This unbalances the capacitance between the two orthogonal loop circuits resulting in circular polarization as shown in FIG. 8 with the resulting antenna gain pattern thereof being shown in FIG. 9.

In general, the method and apparatus of the present invention requires only a single RF port or feed. Polarization switching is accomplished by low-cost, fast, reliable solid-state switches. Closing a switch provides a ground path for the loop and consequently current will flow. The phase of the current can be augmented by passive components resulting in the ability to provide circular polarization over a narrow band. For the case of selectable linear polarization, closing one switch and leaving the other open provides polarization along the axis of the energized loop. Switching polarizations is accomplished by reversing the switch states. Additionally, the antenna uses a capacitively coupled loop structure to lower the natural resonant frequency providing a compact antenna.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

The invention claimed is:

1. A compact polarization agile antenna comprising:

a single RF feed;

a dual-orthogonal structure consisting of a first and a second loop, each of the said loops including a plurality of metallic strips mounted on a dielectric substrate, said loops being connected to the RF feed and to ground through a first and second switch, respectively, whereby current flows in said first and second loops respectively, when the first and second switch are selectively closed; and wherein the RF feed includes a first metallic strip and a pair of signal feed strip portions extending outwardly therefrom; and wherein each of the loops further includes a main radiating leg spaced closely adjacent to a respective one of the signal feed strip portions of the RF feed and a ground strip spaced closely adjacent a portion of said radiating leg and connected to ground by a respective one of said switches.

2. The antenna defined in claim 1 wherein each of the radiating legs of the orthogonal loop structure extends parallel with and spaced closely adjacent one of the signal feed strip portions by a gap; and in which the width of said gaps determines a capacitive coupling in each of the loops.

3. The antenna defined in claim 1 wherein the substrate has a cubical configuration with the first metallic strip extending along the Z-axis of the substrate; and in which the radiating legs extend along the X-axis and Y-axis respectively of the substrate.

4. The antenna defined in claim 3 wherein the cubical substrate has a top surface with an area less than $0.01\lambda^2$.

5. The antenna defined in claim 3 wherein first and second switches are incorporated into the cubical substrate.

6. The antenna defined in claim 1 wherein each of the loops is connected to ground through a complex impedance for controlling the relative phase of the current in each leg for narrowband circular-polarized applications.

7. The antenna defined in claim 1 wherein each of the loops is connected to ground through a short circuit.

8. A method of changing antenna polarization comprising the steps of:

providing a dual-orthogonal loop structure including first and second loops, each of said loops having a switch connecting the loop to ground;

providing a single RF feed to the first and second loops;

forming each of the loops of a plurality of metallic strips on a dielectric substrate;

providing each of the loops with a first metallic strip extending along an axis of the substrate, a second metallic strip extending closely adjacent to and spaced from a first portion of the first strip and a third metallic strip extending closely adjacent to and spaced from a second portion of the first strip and connecting said third strip to ground;

providing a fourth metallic strip operatively connecting the first strip to the RF feed; and closing one of the switches whereby current flows in the associated loop containing said closed switch to provide a linear polarized field.

9. The method defined in claim 8 including the steps of providing an impedance in one of said loops, and closing the other of said switches whereby current flows in both of said loops to provide a circular polarized field.

10. The method defined in claim 8 including the step of opening said one switches and closing the other of said switches to switch the linear polarization.

* * * * *